US007382268B2

(12) United States Patent
Hartman

(10) Patent No.: US 7,382,268 B2
(45) Date of Patent: Jun. 3, 2008

(54) DEVICE AND METHOD FOR TETHERING A PERSON WIRELESSLY WITH A CELLULAR TELEPHONE

(76) Inventor: Kevin L. Hartman, 61 Mulberry St., Cincinnati, OH (US) 45202

( * ) Notice: Subject to any disclaimer, the term of this patent is extended or adjusted under 35 U.S.C. 154(b) by 21 days.

(21) Appl. No.: 11/423,828

(22) Filed: Jun. 13, 2006

(65) Prior Publication Data

US 2007/0285258 A1 Dec. 13, 2007

(51) Int. Cl.
*G08B 23/00* (2006.01)

(52) U.S. Cl. ..... 340/573.1; 340/573.4; 340/568.1; 340/539.1; 340/539.15

(58) Field of Classification Search ..... 340/539.1, 340/539.11, 539.13, 539.14, 539.15, 539.31, 340/573.4, 573.1, 568.2, 568.1
See application file for complete search history.

(56) References Cited

U.S. PATENT DOCUMENTS 4,843,377 A 6/1989 Fuller et al.
4,916,435 A 4/1990 Fuller
4,980,671 A 12/1990 McCurdy
4,999,613 A 3/1991 Williamson et al.
5,266,944 A 11/1993 Carroll et al.
5,298,884 A 3/1994 Gilmore et al.
5,396,227 A 3/1995 Carroll et al.
5,661,458 A 8/1997 Page et al.
5,731,757 A 3/1998 Layson, Jr.
5,831,535 A 11/1998 Reisman et al.
5,841,352 A * 11/1998 Prakash ..... 340/573.4
5,867,103 A 2/1999 Taylor, Jr.
5,870,029 A 2/1999 Otto et al.
5,936,529 A 8/1999 Reisman et al.
5,959,533 A 9/1999 Layson, Jr. et al.
6,072,396 A 6/2000 Gaukel
6,100,806 A 8/2000 Gaukel
6,236,319 B1 5/2001 Pitzer et al.
6,275,159 B1 8/2001 Pinnow et al.
6,433,689 B1 8/2002 Hovind et al.
6,492,906 B1 12/2002 Richards et al.
6,563,427 B2 5/2003 Bero et al.
6,639,516 B1 10/2003 Copley
6,646,617 B1 11/2003 Gaukel
6,700,493 B1 3/2004 Robinson
6,747,562 B2 6/2004 Giraldin et al.
6,748,792 B1 6/2004 Freund et al.
6,774,797 B2 8/2004 Freathy et al.
6,774,799 B2 8/2004 Defant et al.
6,844,816 B1 1/2005 Melton et al.
6,975,234 B2 * 12/2005 Boccacci ..... 340/573.4
7,084,771 B2 * 8/2006 Gonzalez ..... 340/573.1
7,123,141 B2 * 10/2006 Contestabile ..... 340/539.13
2002/0084130 A1 7/2002 Der Ghazarian et al.
2003/0222781 A1 12/2003 Defant et al.

* cited by examiner

*Primary Examiner*—Anh V La
(74) *Attorney, Agent, or Firm*—Wood, Herron & Evans, LLP

(57) ABSTRACT

A system for monitoring activities of a person. The system has a tethering device with a battery-powered transceiver and a securement device that is attachable to a person. The securement device is configured to prevent and detect tampering and attempts to remove the securement device from the person. The system further has a cellular telephone with a transceiver operable to establish a shorter range wireless connection with the tethering device transceiver, thereby permitting tethering device information to be transmitted to the cellular telephone.

18 Claims, 6 Drawing Sheets

DEVICE AND METHOD FOR TETHERING A PERSON WIRELESSLY WITH A CELLULAR TELEPHONE

FIELD OF THE INVENTION

This invention relates to tracking systems and more particularly, to a system in which a wireless transceiver is secured to a person to restrict and/or monitor a location of the person.

BACKGROUND OF THE INVENTION

Approximately 7 million people or 3.2% of all adults in North America are on probation, in jail or prison, or on parole. Billions of taxpayer dollars continue to be spent on prison construction each year, yet an estimated 3.8 million offenders are put on probation and another 400,000 individuals are released on parole from state and federal prisons and returned to the community each year. The enormous growth of the probation and parole population has outpaced available resources, and caseloads have expanded to unmanageable proportions. Many jurisdictions have instituted community-based alternatives to incarceration such as house arrest or electronic monitoring.

Electronic monitoring is an automated method of determining compliance with home confinement restrictions through the use of electronic devices. The most popular form of electronic monitoring uses a radio frequency ("RF") communication system; whereby a transmitter is attached to the offender's ankle and a corresponding receiver is placed in the offender's home. The receiver is attached to the offender's telephone line and sends information to a central computer station. The transmitter on the offender's ankle continuously signals the receiver and has a predetermined range. If the offender exceeds that range or tampers with the equipment, the receiver calls the central computer station; an alarm is generated; and the authorities are notified.

RF communication systems only monitor the presence or absence of the offender at their residence. Furthermore, the central computer can be programmed for scheduled away times or "leaves" to allow the offender to go to work, attend school or counseling, or run errands such as grocery shopping. During these away times, the offender is not being monitored. As probation and parole agencies are forced to accept higher risk offenders from the overburdened corrections system, there is a desire for electronic monitoring systems that provide more information and accountability to maintain public safety.

In the mid-1990's companies began developing and testing electronic monitoring equipment having global positioning system ("GPS") capability. As with any new technology application, early GPS units were cumbersome and unreliable. Today, three companies have emerged with viable GPS units; however, there are still shortcomings that have limited their acceptance.

Known GPS units often use a two-piece system consisting of an RF transmitter attached to the offender's ankle and a tracking unit that the offender must carry with them while away from home. The transmitter electronically tethers the offender to the tracking unit and generally has a range of between 10 and 30 feet. There are two types of GPS tracking units: active and passive. Active GPS tracking units automatically determine their location and call their location in to a central computer station at regular intervals. In addition, any violations such as tampering with the equipment or violating an inclusion or exclusion zone rule (Geo-fencing) are called in immediately; and the unit can also be polled to obtain up to the minute information. A cellular communications link is used by these units, which requires that the active GPS units be in an area with good cellular coverage. Passive GPS units store all the information they obtain, including any violations. When the offender returns home, the passive GPS unit is placed in a docking station connected to a telephone line and information from the passive GPS unit is downloaded to the central computer station.

Current active GPS units are expensive, require good cellular coverage and frequent battery charging, whereas passive units do not give real time information, which minimizes their effectiveness in providing offender accountability and appropriate public safety.

All of the currently available electronic monitoring products and services (including GPS-based) are proprietary systems. The ankle band transmitter, the receiver or tracking device, central monitoring computer and software have all been specially designed at great expense. This cost must be recouped in the price of the equipment and service. In addition, such proprietary systems limit the innovation and technological advances that may be later integrated. Any changes and improvements require a substantial development cost that must be amortized over a relatively long period of time. Therefore, much of the equipment currently in use is either very expensive, uses old technology or both.

Therefore, there is a need for an improved tracking system that does not have the above-described disadvantages.

SUMMARY OF THE INVENTION

The present invention provides an electronic tethering device that functions with a commercially available cellular telephone and thus, utilizes nonproprietary systems for monitoring of a location of the tethering device. The tethering device of the present invention permits a continuous monitoring of a wireless connection with the tethering device by the cellular telephone, thereby permitting a timely warning in the event that the wireless connection is broken or lost for a period of time. The tethering device of the present invention is programmable on-site via the cellular telephone contemporaneously with the tethering device being connected to a person. Further, the tethering device of the present invention provides a low but acceptable battery state permitting an improved determination of when a battery should be replaced. Further, the activity level of the tethering device can be adjusted to better manage prospective battery life. The tethering device of the present invention is cost effective and especially useful with a confinement monitoring system that is monitoring and tracking an offender on probation, parole, awaiting trial or otherwise sentenced by a court or supervising agency and is in an electronic monitoring program.

More specifically, in one first embodiment, the invention provides a system for monitoring activities of a person. The system has a tethering device with a battery-powered transceiver and a securement device that is attachable to a person. The securement device is configured to prevent and detect tampering and attempts to remove the securement device from the person. The system further has a cellular telephone with a transceiver operable to establish a shorter range wireless connection with the tethering device transceiver, thereby permitting tethering device information to transmitted to the cellular telephone.

In one aspect of this invention, the cellular telephone has a GPS data collection capability and is operable to be wirelessly connected to a geographically remote computer system for storing the tethering device information.

In another aspect of this invention, the cellular telephone and tethering device are operable to initiate a shorter range wireless connection therebetween and periodically determine a status state of the battery powering the tether device module. The status state is one of a good battery voltage, a low but acceptable battery voltage and an inoperable battery voltage. The status state is periodically transferred from the tethering device to the cellular telephone and presented on a display of the cellular telephone. In a related aspect, a keypad on the cellular telephone is used to enter a parametric value for the tethering device module in response to the status state representing the low but acceptable battery voltage; and that parametric value is transferred over the shorter range wireless connection from the cellular telephone to the tethering device.

These and other objects and advantages of the present invention will become more readily apparent during the following detailed description taken in conjunction with the drawings herein.

DETAILED DESCRIPTION

Figure 1:
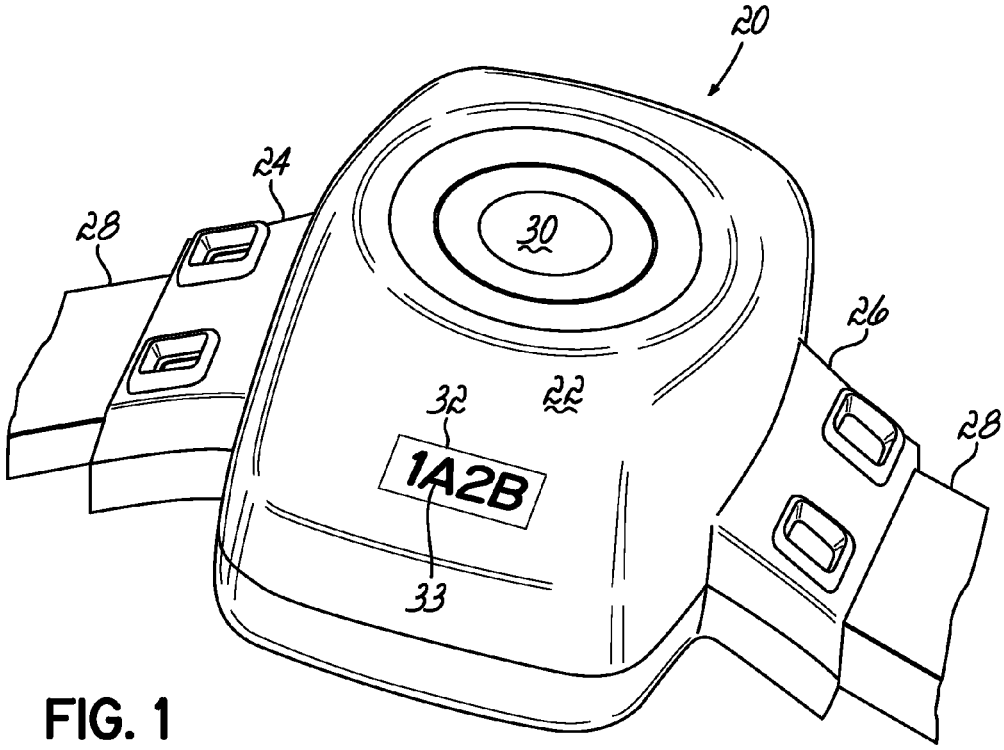
FIG. 1 is a perspective view of one exemplary embodiment of a tethering device in accordance the principles of the present invention.

Referring to FIG. 1, a tethering device 20 has a hollow body 22 with opposed outward extending strap connectors 24, 26. The hollow body 22 has a length of about 66 millimeters ("mm") and a width of about 46 mm; and therefore, the tethering device 20 is sized to comfortably fit around a user's ankle. A continuous strap 28 is connected at its ends to the connectors 24-26 with pins (not shown) in a known manner. The strap 28 contains electrically and optically conductive elements (not shown) that extend over a full length of the strap. Those conductive elements terminate in connectors 24, 26 in a known manner so that an alarm can be given if electrical and/or optical continuity is interrupted. A Start push button 30 is used to activate the tethering device 20. A label 32 is attached to the body 22 and contains indicia 33, for example, a four digit code that is used to uniquely identify the tethering device 20. The tethering device 20 may be constructed of a rugged and durable material, for example, plastic and/or rubber compounds that are hypoallergenic.

Figure 2:
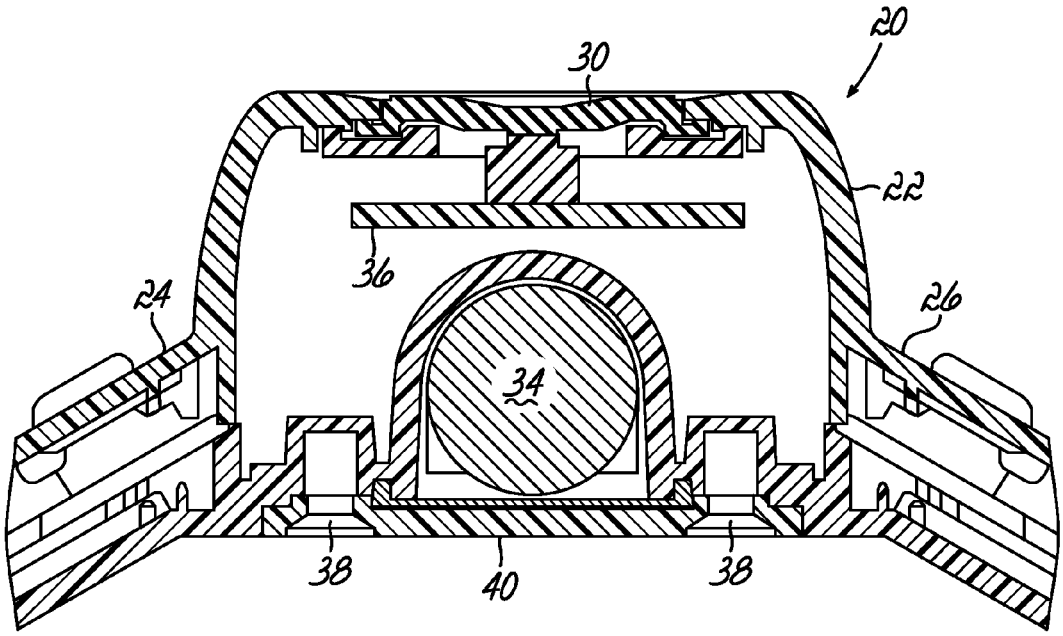
FIG. 2 is a cross-sectional view of the tethering device of FIG. 1.
Figure 3:
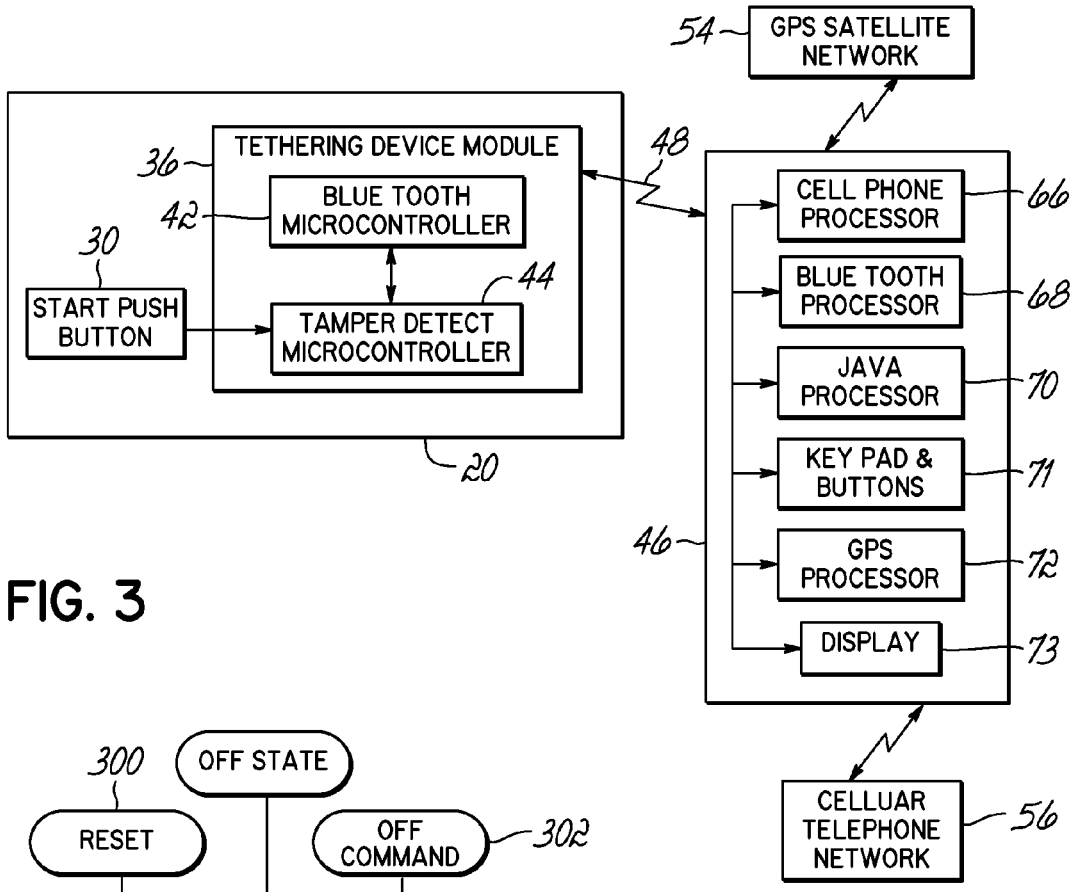
FIG. 3 is an general schematic diagram of a tethering device module within the tethering device of FIG. 1.

As shown in FIG. 2, the body 22 includes a battery 34 that supplies electrical power to a tethering device module 36 that is also operatively connected to the push button 30. Threaded fasteners 38 are used to secure a bottom panel 40 that provides access to the battery 34. The battery 34 is chosen to provide a long operating life and may be, for example, a lithium battery. The tethering device module 36 often is manufactured as a printed circuit board and is shown in more detail in FIG. 3. The module 36 has a BLUETOOTH microcontroller 42 electrically connected to a tamper detect microcontroller 44. The BLUETOOTH microcontroller 42 has a radio frequency transmitter/receiver, that is, transceiver; and an antenna capable of emitting signals at given intervals and uses a wireless communication technology, for example, BLUETOOTH communication technology.

The microcontroller 42 is operable in a known manner to establish a wireless serial connection 48 with a cellular telephone 46 that is BLUETOOTH enabled with a radio frequency transceiver and antenna. Such a wireless connection 48 is often reliably maintained over a shorter range or distance of about thirty feet, but greater separations between the tethering device 20 and cellular telephone 46 often result in the shorter range wireless connection 48 being broken. One exemplary embodiment of the BLUETOOTH microcontroller 42 is a BlueCore2, flash memory, plug-n-go chip with radio and base band for BLUETOOTH 2.4 GHz systems. The BLUETOOTH microcontroller 42 may be implemented using a BC219159B microcontroller or other comparable microcontroller commercially available from many integrated chip suppliers such as CSR Detroit of Auburn Hills, Mich.

An exemplary embodiment of the tethering device microcontroller 44 is a 16 bit, ultra low power microcontroller with flash RAM, a 12 bit analog-to-digital converter ("ADC"), USART and multiple power modes, for example, active, stand by and off modes. Various such commercially available microcontrollers may be used, and one exemplary example of such a microcontroller 44 is an MSP430F135 chip commercially available from Texas Instruments of Dallas, Tex. The tamper detect microcontroller 44 is used to perform substantially all of the functions of the tethering device module 36 except the BLUETOOTH communications function. Such functions include but are not limited to checking the integrity of the strap 28, the state of the battery 34 and other functions.

The cellular telephone 46 is also enabled with JAVA and GPS capabilities, and thus, in addition to a cellular telephone processor 66, the cellular telephone 46 has a BLUETOOTH processor 68, a JAVA processor 70 and a GPS processor 72. The term processor as used herein refers to any combination of programmable computers and controllers and associated programmed instructions or other software that provide the desired functionality. For example, the JAVA processor 70 may be stored program instructions that are executed by the cellular telephone processor 66. The cellular telephone 46 can, in a known manner, establish wireless connections with a cellular telephone network 56 and a GPS satellite network 54. Thus, the cellular telephone 46 can download and store data representing its position, and wirelessly transmit the stored GPS data as well as tethering device data to another entity via the cellular telephone network 56. The cellular telephone 46 has a keypad and buttons 71 and a display 73 that provide an input/output interface. One exemplary embodiment of the cellular telephone 46 is a Motorola I-605 commercially available from Nextel Communications, Inc. of Reston, Va.

Figure 4:
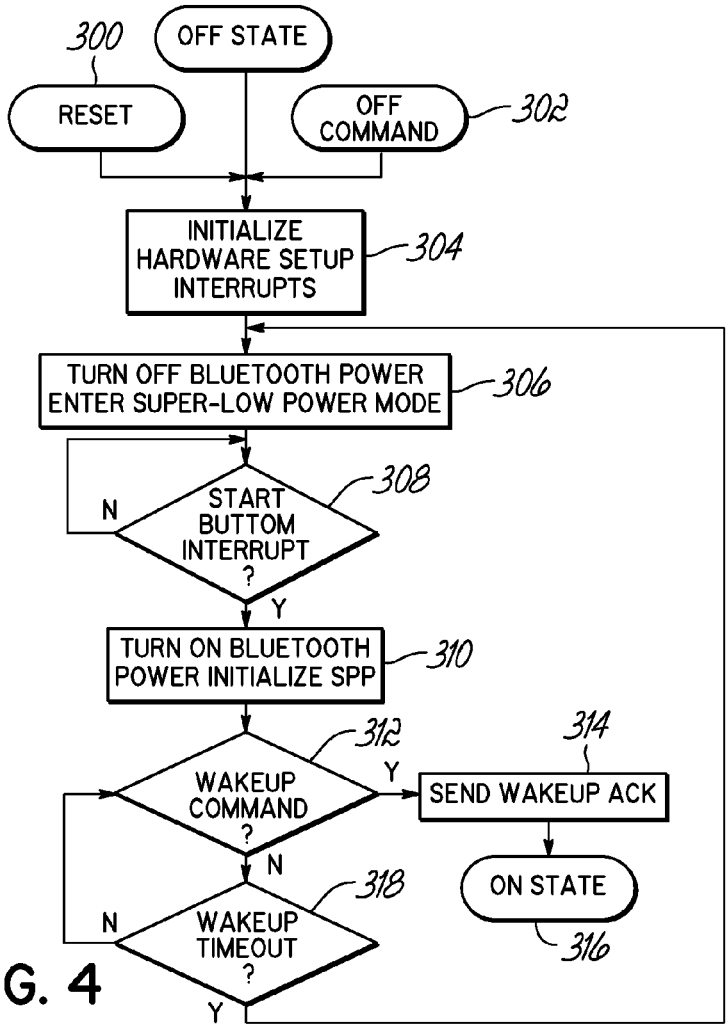
FIG. 4 is a flowchart generally illustrating an Off mode operation of the tethering device module of FIG. 3.

The tethering device module 36 has two main states, an Off state and an On state. The Off state is active during shipment from the factory and when the tethering device 20 is not in active use. The On state is used when active monitoring is desired. The Off state is designed to be the lowest power state for the tethering device module 36. In this state, the module 36 does not report any status data to the cellular telephone 46. As shown in FIG. 4, the Off state of the tethering device module 36 may be entered when a reset command, at 300, is generated upon installing a new battery; and power is applied to the module 36. The Off state may also be activated when the cellular telephone 46 provides, at 302, an Off state command or instruction while in the On state. Upon entering the Off state, the microcontroller 44 first, at 304, initializes or reinitializes the hardware and sets a wakeup interrupt for the Start push button 30. Thereafter, at 306, the tamper detect microcontroller 44 turns off power to the BLUETOOTH microcontroller 42 and switches to its lowest power mode.

Upon detecting the Start push button 30 being pressed, at 308, the microcontroller 44 then, at 310, applies power to the BLUETOOTH microcontroller 42. The BLUETOOTH microcontroller 42 and BLUETOOTH enabled cellular telephone 46 communicate on a serial basis and create a link in a known manner on a master/slave basis in a small network known as a piconet. Further, the wireless RF communication most often occurs over about 79 RF channels having a frequency range of about 2402-2480 MegaHertz. To reduce interference, a frequency hopping sequence is used in which a transmission frequency may hop frequencies up to 1600 times a second. In a piconet network, the first device connecting to the network is defined as a master. In this example, the cellular telephone 46 initiates the serial connection 48 and thus, by definition, is the master. As the master, the cellular telephone 46 sets the serial connection clock, sets a unique frequency hopping sequence, determines the access code for the serial connection and sends a message packet to a slave device that, in this example, is the BLUETOOTH microprocessor 42. The packet permits the slave to resynchronize its clock.

In the exemplary embodiment of FIG. 4, when, at 310, power is applied to the BLUETOOTH microcontroller 42, it will initialize as a slave and go into a Discoverable mode. While the microcontroller 42 is in the Discoverable mode, the cellular telephone 46 performs an Inquiry to find the tethering device 20. The cellular telephone 46 presents to a user a list of tethering device numbers available for pairing. One of the numbers will correspond to the 4-digit code 33 printed on the tethering device's label 32. The operator then selects a number corresponding to the tethering device 20 being used, and the cellular telephone 46 and microcontroller 42 will pair and create a Serial Port Profile (SPP) for a wireless connection or link 48 in a known manner. Once the wireless connection is established, the cellular telephone 46 issues a wakeup command that is detected, at 312, by the BLUETOOTH microcontroller 42. The microcontroller 42 then sends, at 314, an acknowledge signal to the cellular telephone 46; and the tamper detect microcontroller 44 switches the tethering device module 36 to an On state.

Upon the BLUETOOTH microcontroller 42 being turned on, at 310, the microcontroller 44 starts an internal timer. If the cellular telephone 46 does not provide a wakeup command before the internal timer times out, as detected at 318, the microcontroller 44 again enters the Off state by turning off power to the BLUETOOTH microcontroller 42 and switching to its lowest power state; and the microcontroller 42 then awaits another activation of the Start push button 30.

The On state is a normal state for a working tethering device module 36. In general, in this state, the tethering device module 36 reports status data to the cellular telephone 46 over the SPP connection 48 per its configured settings. The cellular telephone 46 reviews the status data and determines whether the configured settings should be changed; and if so, transmits new configuration settings to the tethering device module 36. As described with respect to FIG. 4, the microcontroller 44 switches to the On state in response to a wakeup command from the cellular telephone 46.

Figure 5:
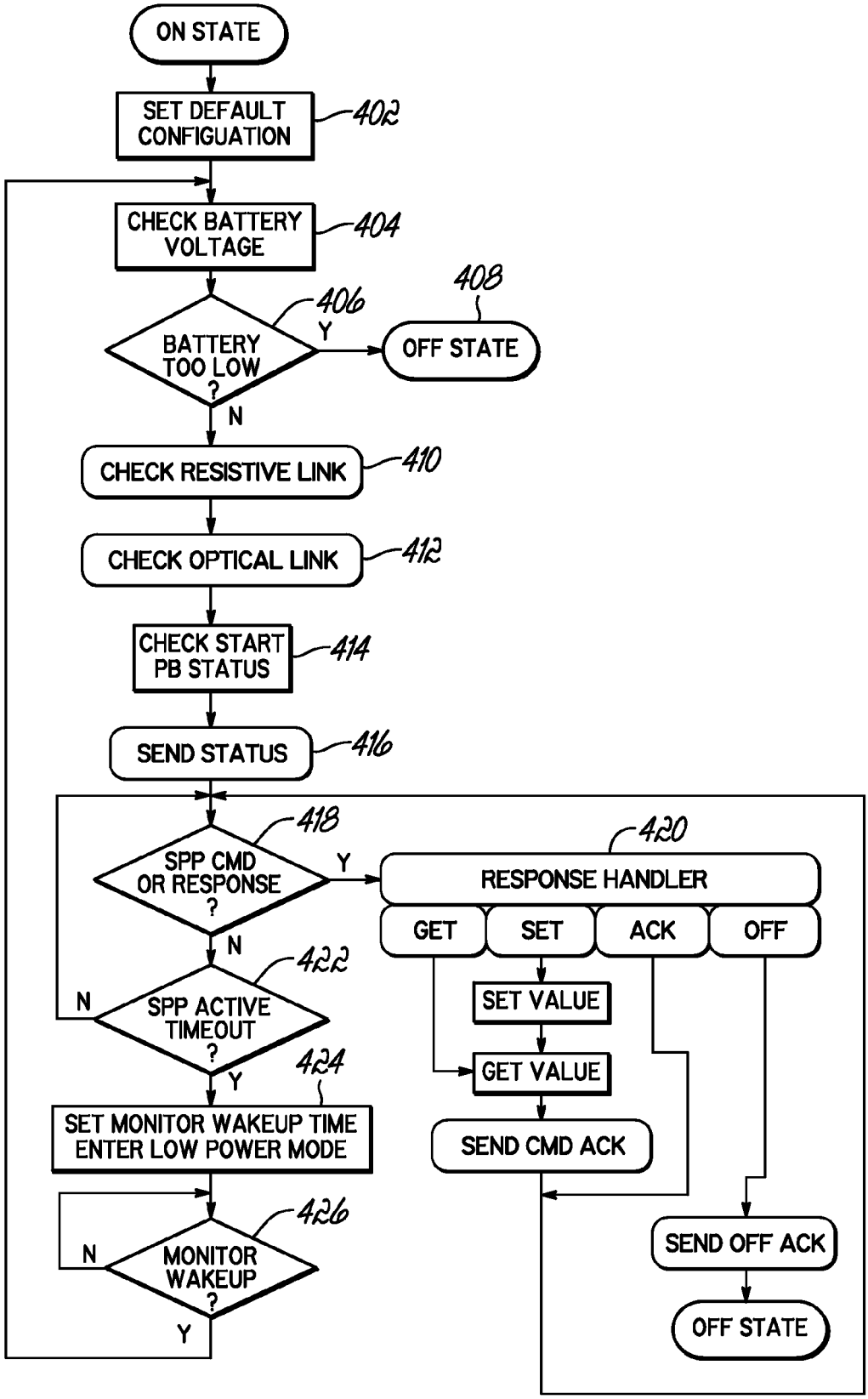
FIG. 5 is a schematic flowchart generally illustrating an On mode operation of the tethering device module of FIG. 3.

Once in the On state, as shown at 402 in FIG. 5, a default configuration is established. After a wakeup command places the microcontroller 42 into the On state, the microcontroller 42 then sends status data to the cellular telephone 46. The cellular telephone 46 can either provide an ACK response or supply a default configuration command to the microcontroller 42. As part of the default configuration, to conserve power, it is desirable to have the BLUETOOTH microcontroller 42 be the master of the SPP connection 48 and the cellular telephone 46 be the slave. Therefore, as part of setting a default configuration, the microcontroller 42 requests a master/slave role reversal to make the microcontroller 42 the master of the SPP connection 48 with the cellular telephone 46 being the slave. A further advantage is that during normal operation after configuration, the BLUETOOTH microcontroller 42 will, in a known manner, setup and enter a BLUETOOTH sniff mode to conserve power between transmissions to the cellular telephone 46. If the cellular telephone 46 goes out of range of the microcontroller 42, the radios in the cellular telephone 46 and microcontroller 42 will enter a reconnect state. If the two devices come back within radio range, the microcontroller 42 will automatically re-establish the SPP connection with the cellular telephone 46.

The microcontroller 44 then, at 404, reads the battery voltage using an internal ADC. The battery voltage is represented by a normalized number in a range of about 0-15. The microcontroller 44 then tests that number against two thresholds set by the tethering device manufacturer. A first threshold represents a battery voltage that is considered to be low, but acceptable for reliable operation, for example, 60 percent of full power or a normalized number of nine. A second threshold represents a minimum battery voltage that is required for the tethering device 20 to reliably operate, for example, 20% of full power or a normalized number of three. If the normalized number is above the first threshold, the battery status is set to Good. However, the number is below the first threshold but above the second threshold, the battery status is set to Low. If the microcontroller 44 determines, at 406, the number is less than the second threshold, the battery is considered not usable; and microcontroller 44 switches, at 408, to the Off state. Next, at 410, the electrical conductive link in the strap 28 is tested. If the microcontroller 44 detects electrical continuity through the strap 28 for a set period of time as determined by a timer in the microcontroller 44, the electrical conductive link status is set to Good; otherwise, it is set to Bad. If there are any attempts to break, cut or remove the monitoring device 20, it is highly probable that either the electrical or optical continuity will be broken.

Thereafter, at 412, the integrity of a fiber optic link in the strap is tested. Using the internal analog to digital converter, the microcontroller 44 tests for optical continuity for a set period of time as determined by a timer in the microcontroller 44. If a desired optical continuity is detected, the optical link status is set to Good; otherwise it is set to Bad. The microcontroller 44 then, at 414, checks the interrupt status of the Start push button. If the Start push button was pressed during the last monitoring interval, the interrupt status will be set to On; otherwise it will be set to Off.

After the microcontroller 44 has determined and stored the status data conditions, the BLUETOOTH microcontroller 42, at 416, commands the status data be sent to the cellular telephone 46 using the serial SPP connection 48. The communication portion of the microcontroller 42 determines, at 418, whether there is an outgoing command or an incoming response over the serial SPP connection 48. Upon the cellular telephone 46 receiving the status data, it may respond with an ACK or a command. If the cellular telephone 46 sends a Set, a Get, or an Off response command, a response handler, at 420, within the microcontroller 42 takes an appropriate action. For example, when the tethering device 20 is being connected to the cellular telephone 46 for the first time, the user is a able to use the cellular telephone keypad 71 to generate a Get command, which causes the cellular telephone 46 to obtain initial status data from the tethering device module 36. Further, using the telephone keypad 71, the user generate other commands to get the version identity of the hardware, firmware and software contained in tethering device module 36. Using the keypad 71 to generate a Set command, the user is able to set programmable parametric values within the tethering device module 36, for example, the sending interval for status data. In addition, in the event that the cellular telephone battery is failing or the tethering device 20 is no longer being used, the cellular telephone keypad 71 can be used to generate an Off command that switches the tethering device module 36 to the Off State. The tethering device module 36 accepts other configuration commands until, as detected at 422, there is no activity on the SPP connection 48 for a timeout period.

Once the configuration is complete, the cellular telephone 46 sends an ACK response, the microcontroller 44 will start, at 424, a monitor wakeup timer and switch to the Low Power mode. At this point, the microcontroller 42 is in a BLUETOOTH sniff mode, that is, a low power mode awaiting communication from the cellular telephone 46. It is desirable for the monitor timeout to be slightly less than the sniff interval to minimize the time needed to wait for the response. Upon the monitor wakeup timer timing out, the microcontroller 44 again checks the status of the strap and battery; and the microcontroller 42 transmits the currently detected tethering device status data to the cellular telephone 46. The process of FIG. 4 continues to iterate as long as the battery 34 stays charged and/or until the cellular telephone 46 issues an Off command.

Figure 6A:
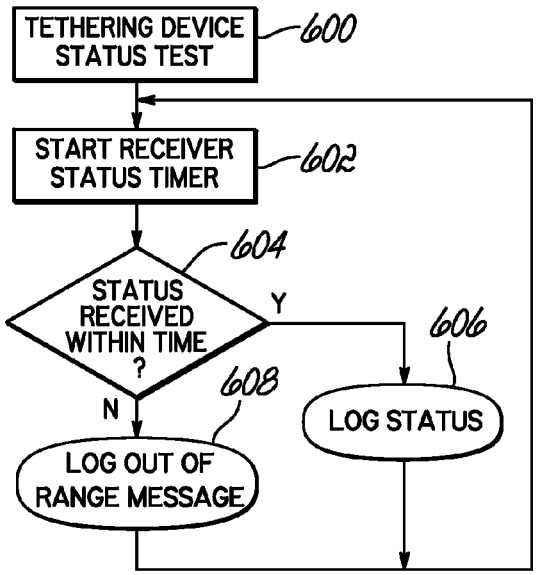
FIG. 6A is a schematic flowchart generally illustrating a process by which a cellular telephone receives status data from the tethering device module of FIG. 3.

Thus, in the On state, the tethering device module 36 and cellular telephone continuously execute a wireless communication relating to tethering device status. In that process, one or more of the processors 66-72 in the cellular telephone 46 are executing a tethering device status test or subroutine 600 shown in FIG. 6A. First, at 602, a start-receive-status timer is begun; and, at 604, a determination is made whether the tethering device status data has been received before the start-receive-status timer times out. If so, at 606, the tethering device status data is logged; and if not, at 608, an out of range state is logged. In some applications, a user wants to know when the tethering device is out of range; however, as will be appreciated, the person carrying he tethering device 20 may, as a part of expected activity, be in and out of range. Therefore, in some embodiments, the out of range state is used to increment a counter; and upon reaching a predetermined count, the cellular telephone sounds an alarm. The sensitivity of the system can be adjusted by changing the predetermined count.

Figure 6B:
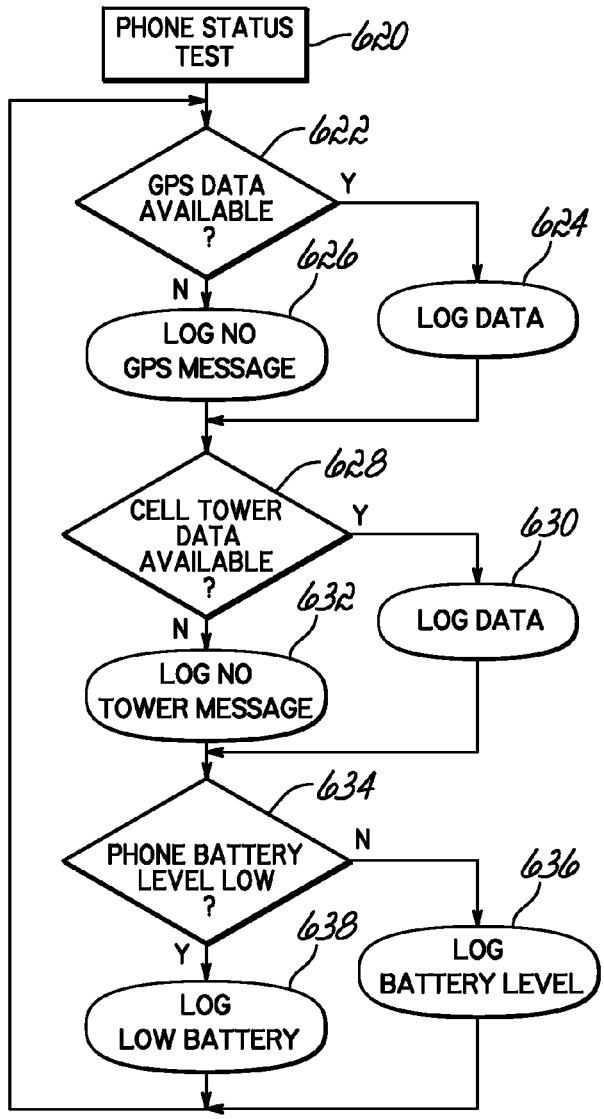
FIG. 6B is a schematic flowchart generally illustrating a process by which a cellular telephone associated with the tethering device module of FIG. 3 determines cellular telephone status data.
Figure 6C:
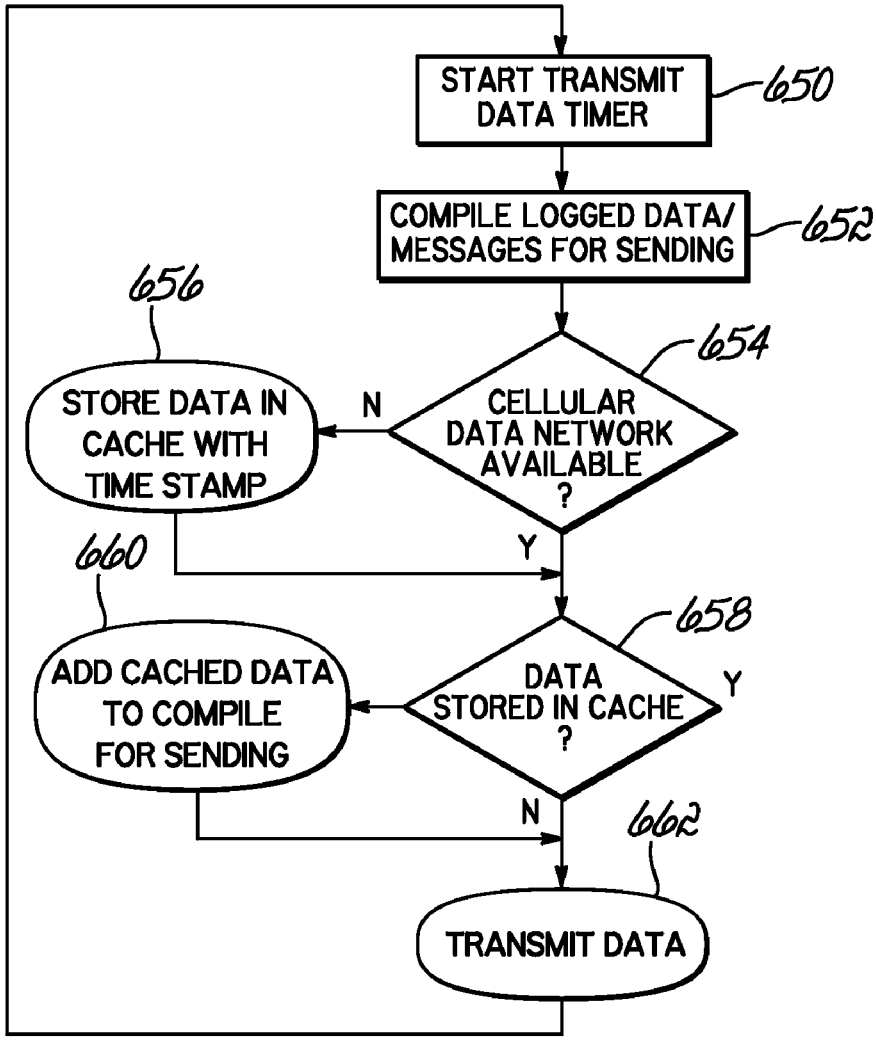
FIG. 6C is a schematic flowchart generally illustrating a process by which a cellular telephone associated with the tethering device module of FIG. 3 communicates tethering device and cellular telephone status data.

Another process running in the cellular telephone 46 is a phone status test 620 shown in FIG. 6B. In this process, the cellular telephone processors 66-72 operate to first, at 622-626, create a log of GPS data availability, and then, at 628-632, create a log of cell tower availability within the cellular telephone network 56, and further, at 634-638, create a log relating to cellular telephone battery condition.

A further process that is running in the cellular telephone 46 is a wireless communication with another device using the cellular telephone network 56. In this process, the cellular telephone processors 66-72 operate to first, at 650, start a transmit data timer. Then, at 652, all of logged data within the cellular telephone 46 is compiled in a message or packet for sending. Next, at 654-656, the availability of the cellular telephone network is checked; and if not available, the data message is stored in a cache with a time stamp. If the network is available, at 658-660, the cached and non-cached data messages are transmitted over the cellular telephone network. The receiver of the data messages will vary with the particular application of the tethering device 20 and cellular telephone 46. However, if the receiver of the data message is actively monitoring the activity of the person wearing the tethering device 20, the receiver of the data message can also process the out of range states to determine whether action is necessary.

Figure 7:
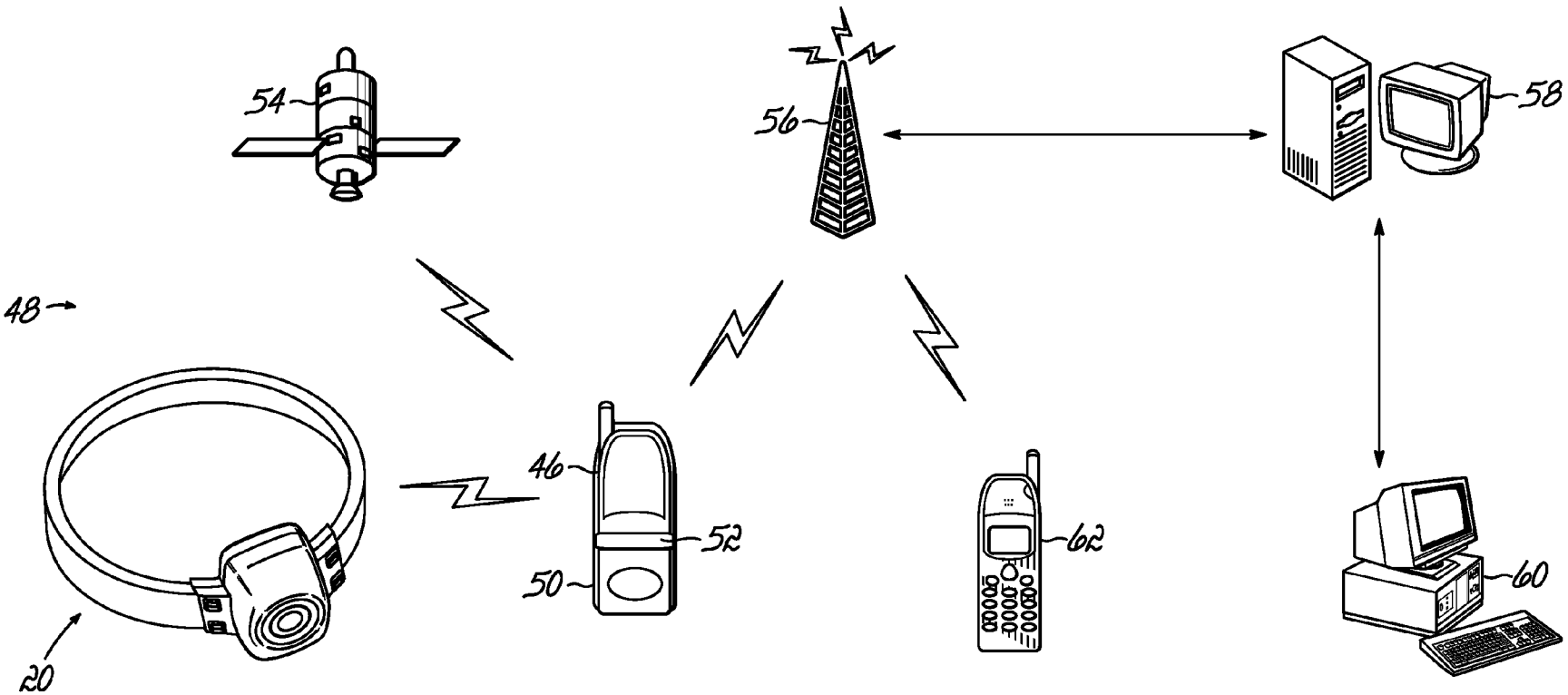
FIG. 7 is a schematic diagram illustrating use of the tethering device of FIG. 1 in an exemplary embodiment of a monitoring system in accordance with the principles of the present invention.

In use, the cellular telephone 46 may be purchased that is BLUETOOTH, JAVA and GPS enabled and programmed using the JAVA API and a compatible service provided by the cellular telephone network 56. Referring to FIG. 7, in one exemplary example, the tethering device 20 and cellular telephone 46 may be utilized with a remote confinement system. Upon an offender being assigned to the remote confinement system, an officer visits the offender to set up the local system. First, the officer can use the telephone display 73 to monitor the tethering device status states and determine the tethering device battery condition. The battery condition can be displayed to the officer using the cellular phone display 73 in several ways. In a first embodiment, the battery condition can be a bar graph having a length representing the remaining life of the battery; or alternatively, the remaining life can be displayed as a percentage of a 100 percent fully charged battery. If the tethering device battery is Low, which means the battery is still usable but will have a limited life, the officer has the option of deciding whether, given an anticipated period of use, a new battery should be installed before the tethering device is put into service. In addition, again, given the anticipated period of use, the battery status and a level of risk of an offender, the officer can use the cellular telephone keypad 71 to set programmable parameters relating to an interval of communication between the tethering device 20 and the cellular telephone 46. Thus, for lower risk offenders, the communication interval can be extended, thereby increasing the probability that the tethering device battery will last over the anticipated period of use. Such a battery management capability reduces system service costs.

Next, the officer pushes the Start button to put the tethering device 20 into Discoverable mode with the cellular telephone 46; and the tethering device 20 pairs with the cellular telephone 46 using the BLUETOOTH pairing system. After pairing, the officer straps the tethering device 20 to the offender's ankle; and then uses the cellular telephone keypad 71 to put the tethering device 20 into the ON state. Further, the officer can set tethering device parametric values using the cellular telephone keypad 71. Given the ability to set such parameters at the location of the offender provides the officer immediate feedback as to the effect of the parameters being set. The ability to setup and establish programmable parameters in the tethering device 20 using the local cellular telephone 46 is a more efficient process compared to other systems that require the tethering device parameters by set from a remote monitoring location, for example, locations 58 or 60 shown in FIG. 7. After setting all of the parameters, the officer then places the cellular telephone in a belt holster 50 and applies a lock 52 to the cellular telephone 46, which prevents the offender from using the cellular telephone 46.

Being GPS enabled, the cellular telephone 46 is able to communicate with a GPS satellite network 54, which permits the location of the offender to be tracked. Being JAVA enabled, the cellular telephone 46 is programmable in a known manner via a commercial cellular telephone network 56 to command various functions. For example, as discussed above, the cellular telephone is able to initiate communications with, and establish configuration settings in, the tethering device 20. Further, at periodic intervals that are programmable by an officer using the cellular telephone 46, the cellular telephone 46 receives, stores and transmits status information from the tethering device 20 to others via a longer range wireless connection with the commercial cellular phone network 56. Such information includes, but is not limited to, the cellular telephone location determined from the GPS network 54, the tethering device identification number, the status of the tethering device battery, whether the tethering device 20 is connected to the offender, whether tethering device 20 is still within communication or radio range of, and thus in electrical communications connected with, the cellular telephone 46.

The tethering device status information including out of range states and cellular telephone location information may be communicated to a geographically remote computer system 58 that functions to monitor the status information and out of range states. Again, the interval at which such messages are communicated is programmable by an officer using the cellular telephone 46. One example of such a geographically remote computer system is a location based services ("LBS") computer system, and the LBS computer system 58 has software capable of processing the information so it can be accessed by or reported to a supervising agency 60. The LBS computer system 58 may be capable of determining compliance with location-based rules and schedules. The LBS computer system 58 may also, or alternatively, be capable of being accessed remotely via the internet by another authorized computer and by other cellular telephones 62 carried by agents or enforcement officers of the supervising agency. Such telephones 62 may be enabled with a GPS capability, so that an officer can view a map and determine an offender's location at any time. Further, the LBS computer system 58 may be capable of notifying the supervising agency 50 and/or an officer cellular telephone 62 of a violation of the location-based rules, schedules, tampering with the tethering device 50, and/or a Low battery status of the tethering device 20 and/or cellular telephone 46 via facsimile, pager, email or SMS to an officer's cellular telephone 62. Thus, depending on the circumstances, the officer can prioritize contact with, or a visit to, the offender. In addition, the LBS computer system 58 is able to archive information received from the cellular telephone 46 in the system for purposes of historical reporting. The telephones 62 may have a push-to-talk capability that allows the officer to talk directly with the offender at any time.

Should the offender get out of range of the cellular telephone 46 or tamper with the tethering device 20 in an attempt to remove it from their ankle, the cellular telephone is configured to send that information via the cellular telephone network 56 to the LBS computer system 58, which, in turn, sends the information to the supervising agency 50.

In the event that a communications link with the LBS computer system 58 is not available, the offender's cellular telephone 46 stores the current location and device information until the communications link again becomes available. Via one or more communications links, the LBS computer system 58, another authorized computer system and/or authorized cellular telephones 62 may access any information stored in the offender's cellular telephone 46.

The tethering device 20 has an advantage of operating with a commercially available cellular telephone and thus, utilizes nonproprietary systems in monitoring a location of the tethering device. The use of nonproprietary systems is cost effective and more amenable to implementing improvements to the system. The tethering device 20 permits a continuous monitoring of its wireless connection with the cellular telephone, thereby permitting a timely warning or notice to others in the event that the wireless connection is broken or lost for a period of time. The tethering device 20 is programmable on-site via the cellular telephone contemporaneously with the tethering device being connected to a person. Further, the tethering device 20 provides a low, but acceptable, battery state permitting an improved determination of when a battery should be replaced as well as better management of prospective battery life. The tethering device 20 is especially useful with a confinement monitoring system that is monitoring and tracking an offender on probation, parole, awaiting trial or otherwise sentenced by a court or supervising agency and is in an electronic monitoring program.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, the tethering device 20 is described as being used with an offender electronic monitoring system of FIG. 7 in which the tethering device 20 is not to be removed by the offender. In other exemplary embodiments of tethering a person to a cellular telephone, the tethering device 20 need only be physically associated with the person in some manner. For example, it may be clipped or pinned to a piece of clothing; or it may be reconfigured as a fob that fits on a key chain or is simply carried in a pocket or purse. In these examples that do not require a high security strap, the physical size of the tethering device 20 can a substantially reduced. In these embodiments, the tethering device 20 and associated cellular telephone 46 may be used to monitor the activity of patients in care facilities, children, persons at risk of being kidnapped and other persons. Further, if the tethering device 20 is made smaller like a fob, it may be used to track and/or find a cellular telephone. In this embodiment, the cellular telephone would not have to be GPS enabled.

Therefore, the invention in its broadest aspects is not limited to the specific details shown and described. Consequently, departures may be made from the details described herein without departing from the spirit and scope of the claims which follow.

What is claimed is:

1. A system for electronically securely tethering a person to a cellular telephone comprising:

a tethering device comprising a battery-powered transceiver for transmitting and receiving data relating to the tethering device, and a securement device adapted to be attachable to the person, the securement device being configured to prevent and detect tampering and attempts to remove the securement device from the person; and a cellular telephone comprising a first transceiver operable to establish a shorter range two-way wireless connection with the transceiver in the tethering device for transmitting and receiving data relating to the tethering device, the two-way wireless connection being an authenticated paired communications link confirming the tethering device and the cellular telephone are within the shorter range of each other.

2. The system of claim 1 wherein the tethering device further comprises a Start push button connected to the battery powered wireless transceiver.

3. The system of claim 2 wherein the tethering device further comprises:

a first microcontroller operable to establish and maintain the shorter range two-way wireless connection with the cellular telephone; and a second microcontroller in electrical communications with the first microcontroller and operable to transmit the data to, and receive other data from, the first microcontroller.

4. The system of claim 1 wherein the cellular telephone further comprises a keypad operable to input into the cellular telephone and transfer to the tethering device via the two-way shorter range wireless connection a parametric value relating to an operation of the tethering device.

5. The system of claim 1 wherein the cellular telephone comprises a location data collection capability adapted to receive information relating to a position of the cellular telephone.

6. The system of claim 1 wherein the cellular telephone comprises a second transceiver adapted to be operable to establish a longer range communication link with a commercial cellular telephone network.

7. The system of claim 6 further comprising a remote computer system geographically remote from, and in wireless electrical communication with, the cellular telephone network, the remote computer system receiving and storing the data relating to the tethering device and data relating to the cellular telephone.

8. The system of claim 1 wherein the shorter range two-way wireless connection comprises a sole and exclusive communication link with the tethering device.

9. The system of claim 3 wherein the tethering device comprises a battery and the second microcontroller is operative to determine respective status states of the battery, the securement device and the Start push button and to transfer the respective status states to the first microprocessor, and the first microprocessor is operative to transfer the respective status states over the two-way shorter range wireless connection to the cellular telephone.

10. The system of claim 4 wherein the tethering device further comprises:

a first microcontroller operable to establish and maintain the shorter range two-way wireless connection with the cellular telephone, the first microcontroller being further operable to receive a parametric value from, and transmit a parametric value to, the cellular telephone; and a second microcontroller in electrical communications with the first microcontroller and operable to receive a parametric value from, and transmit a parametric value to, the first microcontroller.

11. The system of claim 6 wherein the second transceiver in the cellular telephone is operative to communicate the data relating to the tethering device and other data relating to the cellular telephone over the commercial cellular network.

12. A system for electronically tethering a person to a cellular telephone comprising:

a tethering device module comprising a battery, and a first transceiver operable to transmit and receive data relating to the tethering device;

a start push button operatively connected to the first transceiver to initiate operation of the tethering device module;

a securement device adapted to be attachable to the person, the securement device being configured to prevent and detect tampering and attempts to remove the securement device from the person; and a cellular telephone comprising a second transceiver operable to establish a shorter range wireless connection with the tethering device for transmitting and receiving data relating to the tethering device, the shorter range wireless connection being an authenticated paired communications link confirming the tethering device and the cellular telephone are within a range of each other, and a location data collection capability adapted to receive information relating to a position of the cellular telephone.

13. The system of claim 12 wherein the tethering device comprises:

a first microcontroller operable to establish the shorter range wireless connection with the cellular telephone; and a second microcontroller in electrical communications with the first microcontroller and operable to transmit the data to, and receive other data from, the first microcontroller.

14. The system of claim 12 wherein the cellular telephone comprises a third transceiver adapted to be operable to establish a longer range communication link with a commercial cellular telephone network.

15. A method for electronically tethering a person to a cellular phone comprising:

providing a tethering device comprising a battery;

a programmable tethering device module having a first transceiver powered by the battery, a securement device adapted to be attachable to the person, the securement device being configured to prevent and detect tampering and attempts to remove the securement device from the person; and a cellular telephone having a second transceiver, a keypad and a display, establishing and maintaining between the first and the second transceivers an authenticated paired two-way communications link confirming the tethering device and the cellular telephone are within a range of each other, monitoring a first status state of the securement device;

determining a second status state of the battery powering the tethering device module, the second status state representing levels of a battery voltage, transferring the first and the second status states over the two-way communications link from the tethering device to the cellular telephone, and presenting the first and the second status states on the display of the cellular telephone.

16. The method of claim 15 further comprising:

producing with the keypad on the cellular telephone a parametric value for the tethering device module; and transferring the parametric value over the two-way communications link from the cellular telephone to the tethering device.

17. A method of electronically tethering a person to a cellular telephone comprising:

establishing a shorter range two-way wireless connection between the cellular telephone having a first transceiver and a tethering device comprising a battery-powered second transceiver, the two-way wireless connection being an authenticated paired communications link confirming the tethering device and the cellular telephone are within the shorter range of each other, the tethering device being attachable to the person and being configured to prevent and detect tampering and attempts to remove the securement device from the person;

determining with the cellular telephone a continued existence of the shorter range two-way wireless connection with the tethering device; and generating a signal with the cellular telephone in response to determining an absence of the shorter range two-way wireless connection with the tethering device.

18. The method of claim 17 further comprising presenting with the cellular telephone a display of one of a continued existence of the shorter range two-way wireless connection with the tethering device and an absence of the shorter range two-way wireless connection with the tethering device.

* * * * *